US009790723B2

(12) United States Patent
Bienek et al.

(10) Patent No.: US 9,790,723 B2
(45) Date of Patent: Oct. 17, 2017

(54) DOOR OPERATOR

(71) Applicant: DORMA Deutschland GmbH, Ennepetal (DE)

(72) Inventors: Volker Bienek, Ennepetal (DE); Alexander Hellwig, Ennepetal (DE)

(73) Assignee: DORMA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 14/969,741

(22) Filed: Dec. 15, 2015

(65) Prior Publication Data

US 2016/0177610 A1 Jun. 23, 2016

(30) Foreign Application Priority Data

Dec. 17, 2014 (EP) ..... 14198690

(51) Int. Cl.

| | |
|---|---|
| ***E05F 1/08*** | (2006.01) |
| ***E05F 3/18*** | (2006.01) |
| ***E05F 3/10*** | (2006.01) |
| ***E05F 3/16*** | (2006.01) |

(52) U.S. Cl.

CPC ..... *E05F 3/18* (2013.01); *E05F 3/10* (2013.01); *E05F 3/104* (2013.01); *E05F 3/16* (2013.01)

(58) Field of Classification Search

CPC ... Y10T 16/281; Y10T 16/299; Y10T 16/286; Y10T 16/27; Y10T 16/56; Y10T 16/585; Y10T 16/568; Y10T 16/2799; Y10T 16/552; Y10T 16/276; Y10T 16/2769; Y10T 16/2774; Y10T 16/2771; E05Y 2900/132; E05Y 3/00; E05Y 3/108; E05Y 3/104; E05Y 3/225; E05Y 3/02; E05Y 3/04; E05Y 3/06; E05Y 3/08; E05Y 3/10; E05Y 3/16; E05Y 3/18; E05Y 3/22; E05Y 3/01; E05F 1/08; E05F 1/105; E05F 1/1016; E05F 1/1091; E05F 2003/228

See application file for complete search history.

(56) References Cited

U.S. PATENT DOCUMENTS 3,210,797 A * 10/1965 Heinitz ..... E05F 3/06 16/59
3,668,737 A * 6/1972 Tillmann ..... E05F 3/104 16/312

(Continued)

FOREIGN PATENT DOCUMENTS

EP 2138662 A2 12/2009
EP 2738333 A2 6/2014

(Continued)

*Primary Examiner* — Chuck Mah
(74) *Attorney, Agent, or Firm* — Cantor Colburn LLP

(57) ABSTRACT

A door operator includes a housing and at least one linearly guided piston in the housing. A roller carrier is disposed in the piston and includes a rotatably movable supported pressure roller. The piston is formed as a deep drawn structural component and includes a bottom and a circumferential walling. The support and the axial guiding of the roller carrier with a pressure roller within the piston can be realized in a simple and cost effective manner. Furthermore, an aperture is provided in the bottom of the piston, through which the pressure roller protrudes to the outside beyond the bottom of the piston.

15 Claims, 6 Drawing Sheets

(56) References Cited

U.S. PATENT DOCUMENTS

| | | | | | |
|---|---|---|---|---|---|
| 4,349,939 | A * | 9/1982 | Tillmann | E05F 3/104 16/53 |
| 4,658,468 | A * | 4/1987 | Tillmann | E05F 3/104 16/53 |
| 4,763,384 | A * | 8/1988 | Watabe | E05F 3/104 16/53 |
| 5,417,013 | A * | 5/1995 | Tillmann | E05F 3/104 16/53 |
| 5,802,670 | A * | 9/1998 | Bienek | E05F 3/10 16/53 |
| 5,901,412 | A * | 5/1999 | Jentsch | E05F 3/104 16/53 |
| 7,966,771 | B2 * | 6/2011 | Bienek | E05F 3/104 49/137 |
| D664,830 | S * | 8/2012 | Yu | D8/330 |
| 2007/0033768 | A1 * | 2/2007 | Ginzel | E05F 3/04 16/71 |
| 2008/0127562 | A1 * | 6/2008 | Bienek | E05F 3/104 49/334 |
| 2011/0197391 | A1 * | 8/2011 | Yu | E05F 3/104 16/51 |

FOREIGN PATENT DOCUMENTS

| | | | | | |
|---|---|---|---|---|---|
| EP | 2738334 | A2 | | 6/2014 | |
| GB | 998344 | A | * | 7/1965 | E05F 3/104 |
| GB | 1168984 | A | * | 10/1969 | E05F 3/106 |
| GB | 2462633 | A | | 2/2010 | |
| IT | EP 1134349 | A2 | * | 9/2001 | E05F 3/104 |

* cited by examiner

DOOR OPERATOR

TECHNICAL FIELD

The present disclosure relates to a door operator with a housing and at least one linearly guided piston in the housing, in which piston is disposed a roller carrier with a rotatably movable supported pressure roller, wherein the piston is formed as a deep drawn structural component and includes a bottom and a circumferential walling.

Such a door operator is known. In this door operator, the piston consists of a deep drawn structural component with a bottom and a circumferential walling. A roller carrier, which carries a pressure roller, is disposed in the piston. In this case, the roller carrier with the pressure roller is inserted into the piston in such a way from the open side opposite the bottom that the pressure roller projects beyond the open side of the piston to the outside.

With conventional door operators, the bearing and in particular the axial guide of the roller carrier with the pressure roller within the piston have a complicated configuration.

SUMMARY

Therefore, the present disclosure provides a door operator of the species mentioned in the introduction, in which the bearing and in particular the axial guide of the roller carrier with the pressure roller within the piston can be realized in a simple and inexpensive as well as in a functionally advantageous manner and saving constructional space.

This problem is solved according to the disclosure with a door operator with a housing and at least one linearly guided piston in the housing, in which piston is disposed a roller carrier with a rotatably movable supported pressure roller, wherein the piston is formed as a deep drawn structural component and includes a bottom and a circumferential walling, in that an aperture is provided in the bottom, through which the pressure roller projects beyond the bottom of the piston to the outside.

With this configuration, the bottom which is necessarily produced in the deep drawing process, can be functionally utilized for realizing a support and in particular an axial and radial guide of the roller carrier with the pressure roller within the piston in a simple and inexpensive as well as in a functionally advantageous manner and saving constructional space.

According to an advantageous embodiment, the roller carrier is essentially U-shaped—preferably formed as a stamped and bent part.

According to an advantageous further development, the free branches of the roller carrier protrude beyond the bottom to the outside and are laterally fixed by the aperture. This results in a firm and laterally stable guiding of the roller carrier, respectively of the pressure roller.

So that the roller carrier, respectively the pressure roller are reliably retained also in axial direction of the piston, according to a preferred configuration, the free branches of the roller carrier are provided with lateral shoulders, which serve for supporting the roller carrier at the interior side of the bottom.

Thus, the roller carrier is reliable retained and guided in both the radial and also axial direction of the piston.

Advantageously, flangings, which serve for supporting the roller carrier, are disposed at the circumferential walling of the piston. Said flangings may also serve for the axial and torsion-resistant guiding of the roller carrier, and moreover prevent that, in particular during the mounting procedure, the roller carrier with the pressure roller might fall out of the piston.

According to an advantageous configuration, the pressure roller is supported via a bolt in the roller carrier, wherein the bolt in its axial direction props up against the aperture. Said arrangement guarantees a reliable support and alignment of the pressure roller and moreover prevents that the bearing bolt gets lost.

According to a preferred further development, a carrying plate, which abuts at the roller carrier, may be disposed in the piston. As the roller carrier is usually charged by a spring, a full contact of the spring at the roller carrier can be achieved with said measure. Furthermore, as the open side of the piston is oriented in the direction of the spring, as a consequence of the thin walled piston the spring is able to partially plunge into the latter, such as to save significant construction length of the door operator and/or increase the guiding length of the piston. The closed side of the piston, which is provided with the aperture for the pressure roller, is oriented towards the cam axis, which exactly at that location provides stability to the piston for absorbing transverse forces laterally in the housing, which forces are mainly present at the location of the roller center. Thereby, a number of advantages can be utilized simultaneously, even though the piston is manufactured in a chip-less manufacturing process in a single operation.

Advantageously, the carrying plate may be likewise supported and guided at the flangings in the circumferential walling of the piston. Moreover, the flangings are able to prevent loosing the carrying plate, in particular during mounting.

Advantageously, the carrying plate is formed from a stamped part.

According to a preferred embodiment, the carrying plate can be brought into an operative connection with a spring, which extends through the open side of the piston and into the latter. Based on said configuration, advantageously in particular the overall length of the door operator can be reduced, because the spring can plunge into the piston. Thereby, not only the spring is guided in a better way, but also the piston itself can be made longer, which again contributes to a better guiding of the piston. Thus, even with a shorter door operator, the efficiency thereof can be considerably improved.

In particular with a hydraulically operated door operator, according to a preferred configuration, a non-return valve and/or pressure control valve can be disposed in the carrying plate.

Advantageously, in addition to the aperture, depressions may be provided for accommodating bearing shells and/or other structural components.

Preferably, the piston as well may be formed as a reversed drawn structural component.

According to a preferred configuration, the piston comprises a sheet metal part.

The inventive configuration provides in particular the following advantages:

On the side facing away from the bottom, the piston is completely open, which allows for a simple and cost-advantageous manufacturing. Simultaneously, the piston, on account of its thin-walled embodiment, is able to accommodate a portion of the spring inside the piston. Thereby, reducing the length of the door operator is possible. Simultaneously, an increase of the guiding length of the piston is achieved, which effects a good stroke behavior at low friction, tilting and thereby low wear. Moreover, improved running features of the piston are achieved by means of utilizing the inside piston depth.

The transitional bordering between the bottom surface and the circumferential walling, which originates from the deep drawing process, is favorable for a low wear running behavior of the piston in the housing of the door operator.

The pre-mounted roller carrier can be easily pushed into the piston from the open side of the piston, wherein the pressure roller partially plunges through the aperture in the bottom. Furthermore, the roller carrier is laterally guided in the aperture and supported via the lateral shoulders at the interior side of the bottom.

Once installing the door operator is completed, from the inside the pressure of the spring presses the roller carrier against the bottom of the piston and it is thereby reliably axially fixed. For pre-mounting purposes, flangings may be provided in the envelope surface of the piston.

With an appropriate embodiment, an oil-tight separation wall can be realized by means of the carrying plate.

Based on the configuration as a deep drawn part, only very little material use is required. Manufacturing is realized without metal cutting and after manufacturing, the piston is directly ready for mounting without degreasing or cleaning. Almost no sharp edges are produced, manufacturing is realized at high precision and inner stability, and post-machinings can be omitted, as of high precise repeatability.

BRIEF DESCRIPTION OF THE DRAWINGS

Further details, features and advantages of the disclosure will become apparent from the following description, reference being made to the drawings. In the drawings.

DETAILED DESCRIPTION OF THE DRAWINGS

Figure 1:
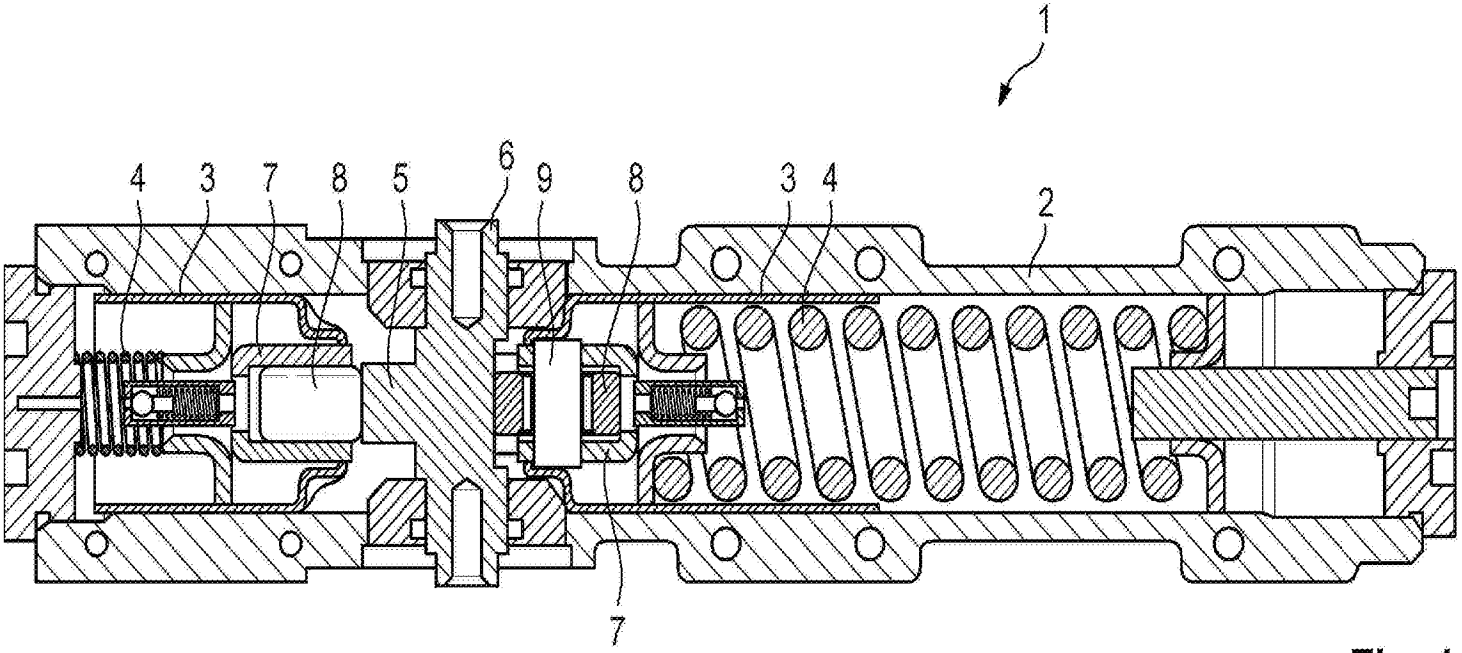
FIG. 1 shows a longitudinal section through an inventive door operator.

In the following description, the door operator 1 illustrated in FIG. 1 will be explained only insofar as it is of interest in the present case.

The door operator 1, which may be for example a door operator with cam technology, includes a housing 2, in which among others a piston 3 is longitudinally displaceable. In the exemplary embodiment illustrated in FIG. 1, two pistons 3 are provided, which however basically have the same configuration. The pistons 3 are charged by respectively one spring 4, which pushes them in the direction towards a cam disc 5, which is attached to a pivoting axis 6 for a door arm assembly.

Figure 2:
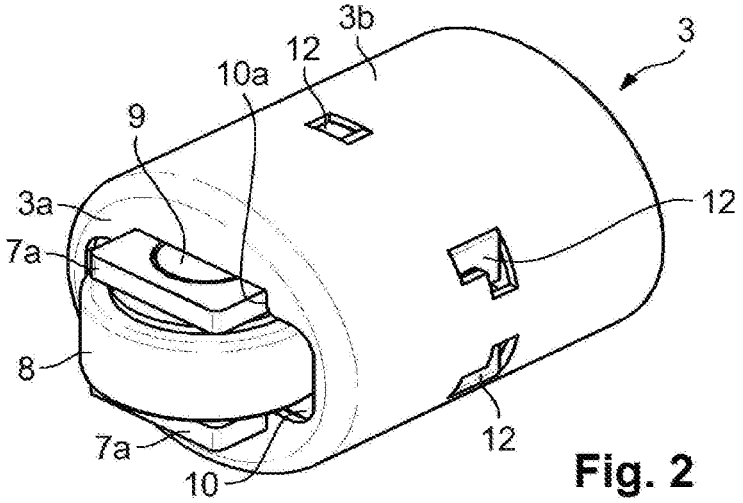
FIG. 2 shows a perspective view of a piston guided in the door operator according to a first embodiment.
Figure 3:
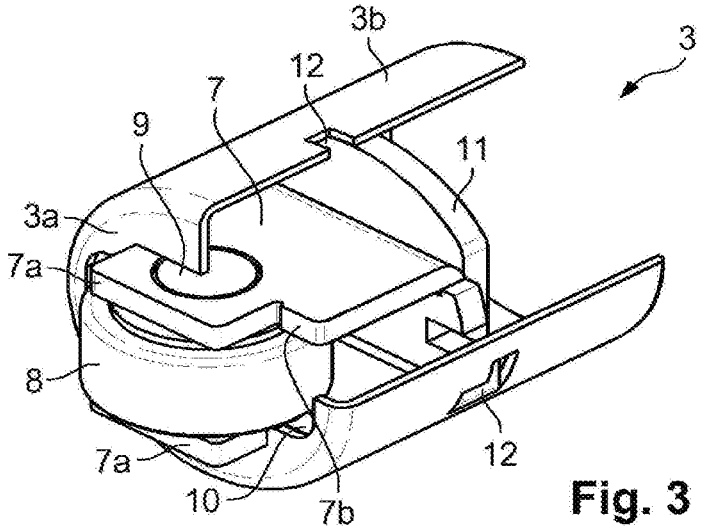
FIG. 3 shows the piston of FIG. 2 in a partially broken view.
Figure 4:
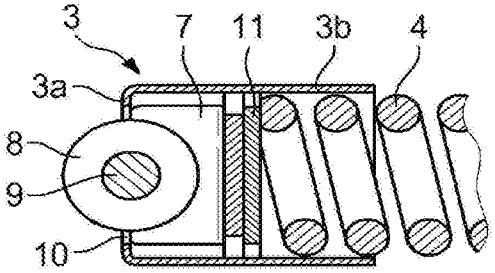
FIG. 4 shows a longitudinal section through the piston according to FIG. 2.

A first embodiment of the piston 3 is illustrated in detail in the FIGS. 2 to 4.

The piston 3 comprises a deep drawn or a reversed drawn sheet metal part, which is configured bowl-shaped or pot-shaped and includes a bottom 3*a* and a circumferential walling 3*b*.

A roller carrier 7, which carries a pressure roller 8, is disposed in the piston 3. Essentially, the roller carrier 7 is formed to be U-shaped with free branches 7*a* and is manufactured from a stamped bent part. The pressure roller 8 is rotatably supported at a bolt 9, which in turn is supported in the free branches 7*a* of the U-shaped roller carrier 7.

An aperture 10, through which the pressure roller 8 via the bottom 3*a* of the piston protrudes to the outside, is disposed in the bottom 3*a* of the piston 3. The aperture 10 is provided with two opposing lateral protrusions 10*a* into which the free branches 7*a* of the U-shaped roller carriers 7 protrude in such a way that the free branches 7*a* are surrounded by the protrusions 10*a* on three sides. Thus, the roller carrier 7 is fixed in the aperture 10 in lateral direction.

At its free branches 7*a*, the roller carrier 7 includes lateral protruding shoulders 7*b*, via which the roller carrier 7*a* is able to prop up at the interior side of the bottom 3*a*.

As the protrusions 10*a* of the aperture 10 surround the free ends 7*a* on three sides, also the bolt 9 supporting the pressure roller 8 is supported and fixed by the protrusions 10*a* in its axial direction.

A carrying plate 11, which may be formed as a stamped part and which abuts against the roller carrier 7, is disposed in the piston 3.

A non-return valve and/or a pressure control valve may be disposed in the carrying plate 11, if it is a hydraulically operated door operator 1.

Flangings 12, which serve for supporting the roller carrier 7 as well as the carrying plate 11, are provided in the circumferential walling 3*b* of the piston. Said flangings 12 may also assist in a torque-proof guiding of the roller carrier 7 and/or the carrying plate 11.

For mounting the piston 3, the roller carrier 7 with the pressure roller 8 as well as the carrying plate 11 are inserted into the piston 3 from the open side. Then, the parts can be reliably maintained in their position by means of the flangings 12.

In the completed mounted condition, the spring 4 extends into the piston 3 from the open side and abuts against the carrying plate 11. In this condition, the shoulders 7*b* of the roller carrier 7 are pressed against the interior side of the bottom 3*a*, while the free branches 7*a* are guided in the protrusions 10*a* in longitudinal direction and retained in transverse direction.

Figure 5:
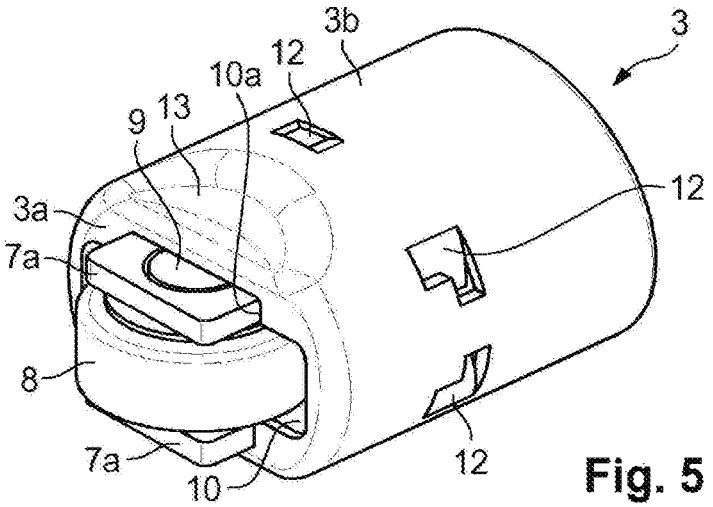
FIG. 5 shows a perspective view of the piston guided in the door operator according to a second embodiment.
Figure 6:
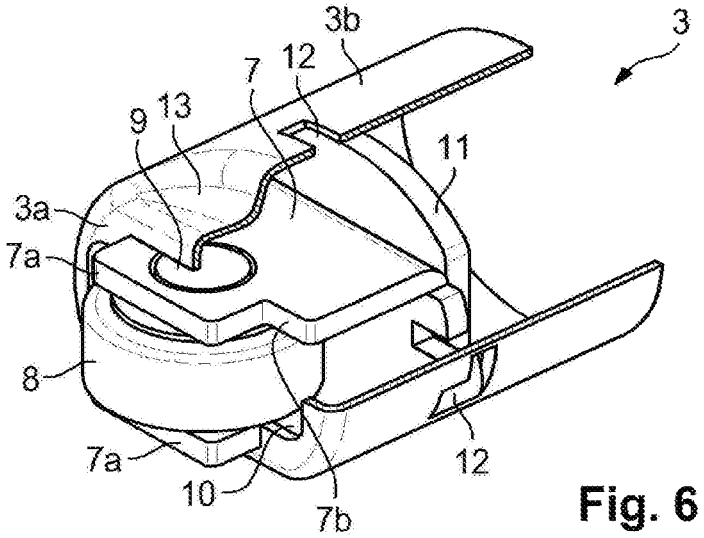
FIG. 6 shows the piston of FIG. 5 in a partially broken view.
Figure 7:
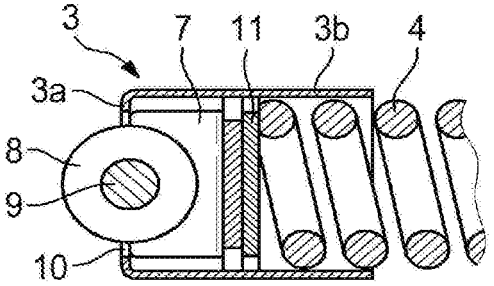
FIG. 7 shows a longitudinal section through the piston according to FIG. 5.

A second embodiment of the piston 3 is illustrated in detail in the FIGS. 5 to 7.

The piston 3 according to this embodiment essentially corresponds to the embodiment shown in the FIGS. 2 to 4. However additionally, in this second embodiment in addition to the aperture 10 depressions 13 are provided, which offer space for the reception of bearing shells and/or other structural components.

On account of the rounding of the bottom 3*a* of the piston 3 caused in the production process, wear is minimized and better efficiency is achieved. Moreover, a relatively long configuration of the piston 3 allows for achieving a better guiding of the piston 3 in the housing 2.

Figure 8:
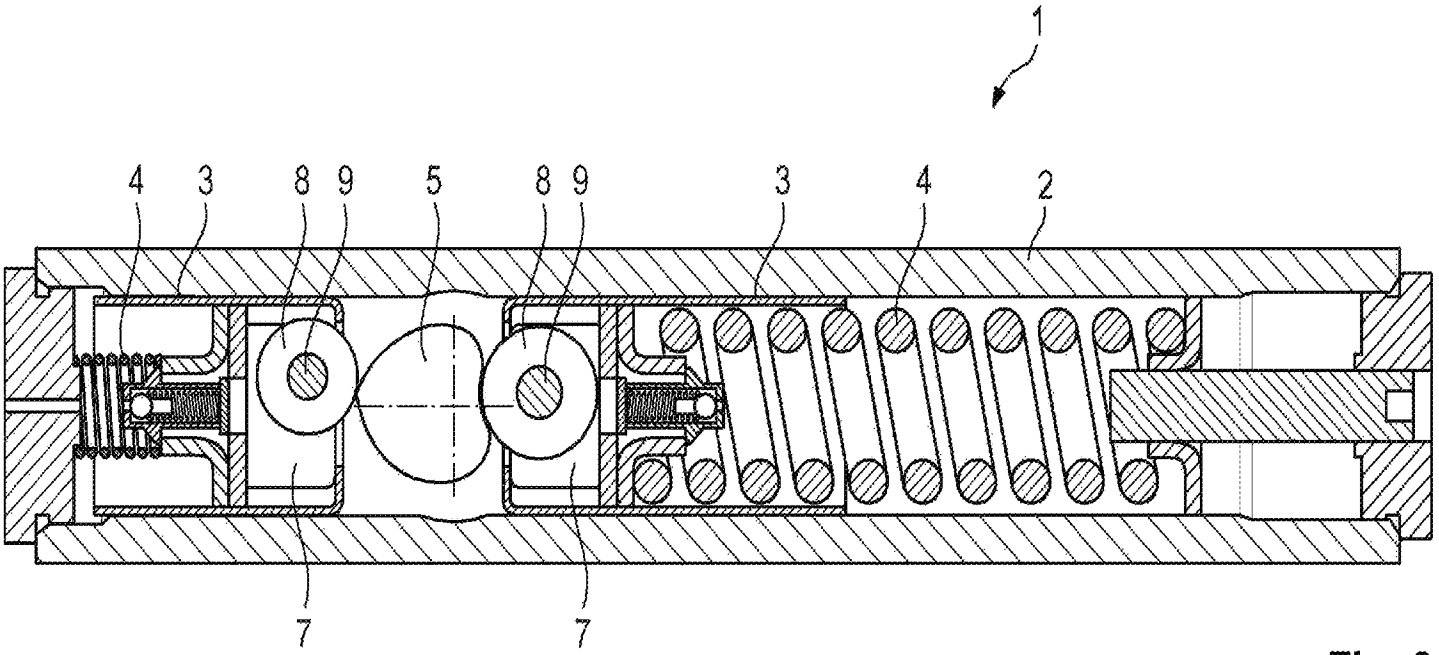
FIG. 8 shows a longitudinal section through the inventive door operator, wherein the cam disc is disposed in a 0° position.
Figure 9:
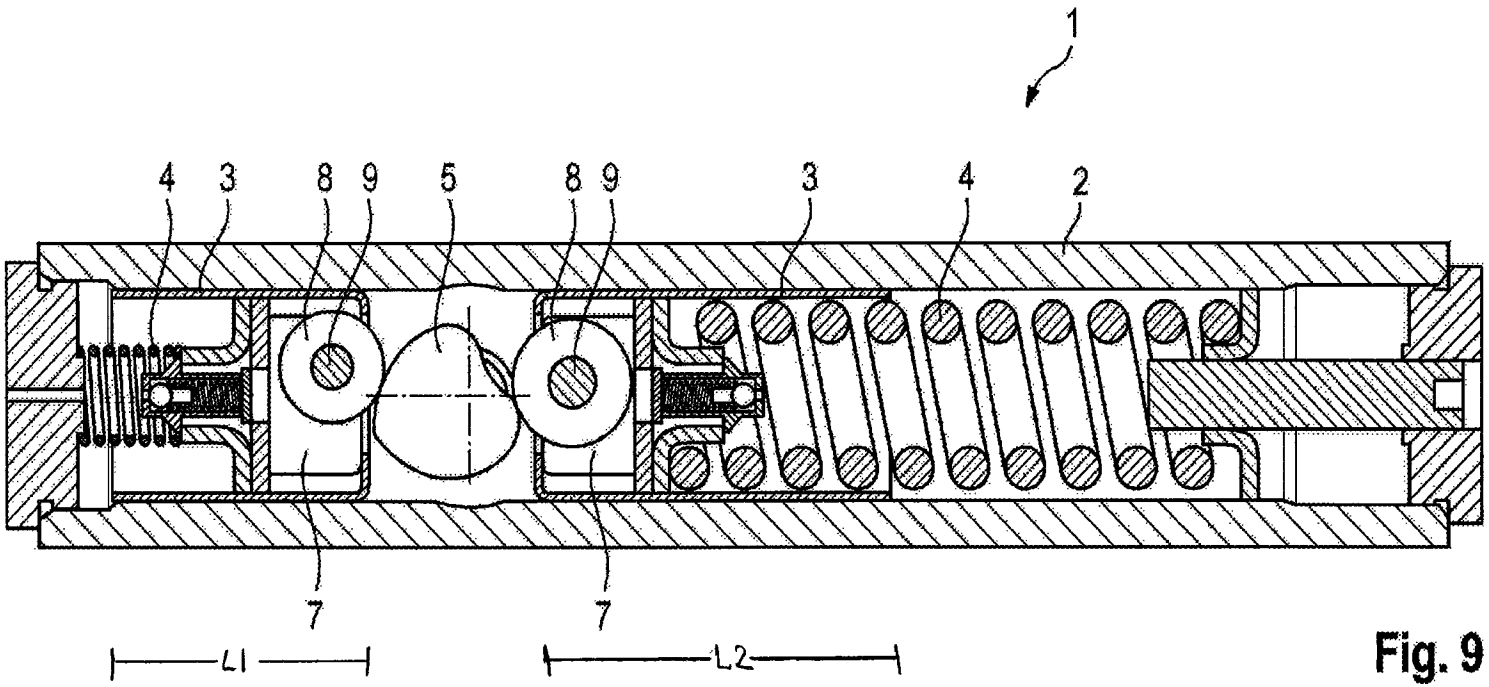
FIG. 9 shows a longitudinal section through the inventive door operator, wherein the cam disc is disposed in a 30° position.

A longitudinal section of the door closer 2 is shown in the FIGS. 8 and 9 in two different positions of the cam disc 5 for illustrating a further advantage of the inventive door closer 1. In particular the force ratios in a door closer 1 with cam disc technology are illustrated in FIG. 9.

The force resultant required for generating a torque M in the cam axis, which force resultant is introduced via the pressure roller 8, generates a force component $F_{spring}$ in the piston 3 acting in a direction of the spring 4 and a transverse acting normal force component $F_n$, which causes a lateral support of the piston 3 at the housing 2.

On account of the tilting effect of the piston 3 within the housing 2 caused by means of the normal force component $F_n$, a punctual contact of the piston 3 in the housing 2 is the result and not a full contact. Depending on the distances L1 and L2 caused by construction, the normal force $F_n$ may be divided into the supporting loads A and B. Said bearing forces A and B—multiplied by the respective friction value μ—result in the frictional forces $F_r$.

The normal force $F_n$ and the friction forces $F_r$ resulting therefrom are essentially responsible for the efficiency of the door closer 1.

The frictional forces $F_r$, opposite to the respective direction of movement, reduce the spring energy stored in the spring 4, respectively increase the opening moment M required for compressing the spring 4.

As the efficiency of the overall mechanical system results from the applied and the recovered energy, an optimization of the support of the piston 3 over the distances L1 and L2 as well as of the friction ratios result in a clear improvement of the efficiency. According to the principle "run the length", larger contact areas are the result at the bearing points, whereby critical peak values with regard to the surface pressure can be avoided.

Thereby, a lower tilting effect of the piston 3 reduces wear, whereby operational soiling of the hydraulic oil is likewise kept low.

Furthermore, lower bearing forces A and B allow for selecting more advantageous materials for the housing 2, respectively for the piston 3. Surface treatments may be likewise reduced, or can be completely omitted.

Thereby, considerable savings can be achieved when manufacturing the individual structural components.

Figure 10:
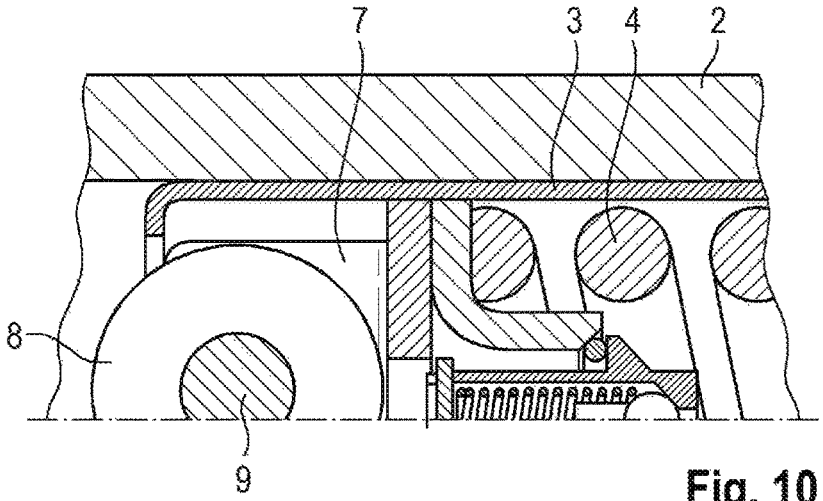
FIG. 10 shows a section of FIG. 9 in an enlarged scale.

As revealed in particular in FIG. 10, the reduction of the bearing forces A and B allow for reducing scorings of the piston 3 into the walling of the housing 2 as a result of too large a tilting movement and material overloading. Conventionally manufactured pistons in a cutting process will score with their chamfer, which is generated during manufacturing, into the housing 2 as a result of the tilting of the piston, whereby soiling and contamination is produced.

However, the inventive configuration of the piston 3, like in a "post on two beams" by means of longer distances L1 and L2 of the bearings and the thereby more centered introduction of force, stabilizes and relaxes the overall system. The normal force $F_n$ on the roller side at the piston radius is lower and the piston 3 runs straighter. The normal force $F_n$ is introduced at the point of the roller bolt center. The frictional force $F_r$ acts opposite to the direction of movement of the piston 3 and reduces the desired spring force of the spring 4.

The preceding description according to the present disclosure serves for illustrative purposes only and is not intended to limit the disclosure. Various changes and modifications are possible within the framework of the disclosure without leaving the scope of the disclosure or the equivalents thereof.

The invention claimed is:

1. A door operator comprising: a housing and at least one linearly guided piston disposed in the housing, a roller carrier disposed in the piston and including a rotatably movable supported pressure roller, wherein the piston is formed as a deep drawn structural component and includes a bottom and a circumferential walling, an aperture is provided in the bottom of the piston and the pressure roller projects outwardly beyond the bottom; and a spring extends into the piston and is configured to move the piston towards a cam which is attached to a pivoting axis for a door assembly.

2. The door operator according to claim 1, wherein the roller carrier is essentially configured as U-shaped.

3. The door operator according to claim 1, wherein the roller carrier is configured as a stamped bent part.

4. The door operator according to claim 2, wherein the roller carrier includes free branches that protrude beyond the bottom outwardly and are laterally fixed by means of the aperture.

5. The door operator according to claim 2, wherein the roller carrier includes free branches having lateral shoulders and serve for supporting the roller carrier at the interior side of the bottom.

6. The door operator according to claim 1, wherein a plurality of flangings, which serve for supporting the roller carrier, are disposed in the circumferential walling of the piston.

7. The door operator according to claim 1, wherein the pressure roller is supported via a bolt in the roller carrier and the bolt is supported in its axial direction at the aperture.

8. The door operator according to claim 1, wherein a carrying plate, which abuts against the roller carrier, is disposed in the piston.

9. The door operator according to claim 8, wherein the carrying plate is able to extend between a plurality of flangings disposed in the circumferential walling of the piston.

10. The door operator according to claim 8, wherein the carrying plate is configured as a stamped bent part.

11. The door operator according to claim 8, wherein the spring abuts against the carrying plate.

12. The door operator according to claim 8, wherein a non-return valve and/or a pressure control valve is disposed in the carrying plate.

13. The door operator according to claim 1, wherein depressions are provided adjacent the bottom and are configured for receiving bearing shells and/or other structural components.

14. The door operator according to claim 1, wherein the piston is configured as a reversed drawn structural component.

15. The door operator according to claim 1, wherein the piston is configured as a sheet metal part.

* * * * *